US006532353B1

(12) United States Patent
Orchard et al.

(10) Patent No.: US 6,532,353 B1
(45) Date of Patent: Mar. 11, 2003

(54) CLEANING WEB ADVANCEMENT AND DRIVE CONTROL MECHANISM

(75) Inventors: James Van Orchard, Holly, NY (US); Terry Nate Morganti, Brockport, NY (US); David Francis Cahill, Rochester, NY (US); James Denny Anthony, Victor, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/473,426

(22) Filed: Dec. 29, 1999

(51) Int. Cl.[7] ..... G03G 15/20; G03G 21/00
(52) U.S. Cl. ..... 399/327; 399/71
(58) Field of Search ..... 399/71, 327, 352

(56) References Cited

U.S. PATENT DOCUMENTS

| | | | | |
|---|---|---|---|---|
| 4,939,552 A | * | 7/1990 | Nakanishi | 399/352 |
| 5,563,695 A | * | 10/1996 | Sakurai et al. | 399/327 |
| 5,848,341 A | * | 12/1998 | Watanabe | 399/327 X |
| 5,850,588 A | * | 12/1998 | Yoshikawa | 399/327 |
| 5,999,786 A | * | 12/1999 | Saito | 399/327 |
| 6,091,925 A | * | 7/2000 | Sugimoto et al. | 399/327 |

FOREIGN PATENT DOCUMENTS

| | | | |
|---|---|---|---|
| JP | 61-98373 | * | 5/1986 |
| JP | 63-276079 | * | 11/1988 |

* cited by examiner

*Primary Examiner*—Fred L Braun
(74) *Attorney, Agent, or Firm*—Lawrence P. Kessler

(57) ABSTRACT

A mechanism for cleaning the surface of an operative element of a reproduction apparatus. The cleaning mechanism includes an elongated web of cleaning cloth material. A first support provides a supply of the elongated web of cleaning cloth material, and a second support provides a take-up for the elongated web of cleaning cloth material. A motor is operatively coupled to the second support to drive the second support for selectively advancing of the elongated web of cleaning cloth material from the first support to the second support to provide a clean portion of the elongated web of cleaning cloth material to clean the operative element. An encoder, associated with the motor, produces a string of pulses while the motor is operative to drive the second support. A logic and control unit produces a signal for turning the motor on for a period of time establishing a web advancement cycle where a given predetermined number of pulses in a pulse string are produced by the encoder. Responsive to the actual number of pulses in the pulse string of an advancement cycle, the period of time that the motor is turned on in a subsequent advancement cycle is adjusted based on the actual number of pulses in a previous string of pulses in order to adjust advancement of the web to provide for the most efficient use of the web of cleaning cloth material.

12 Claims, 3 Drawing Sheets

CLEANING WEB ADVANCEMENT AND DRIVE CONTROL MECHANISM

CROSS-REFERENCE TO RELATED APPLICATIONS

Reference is made to the commonly assigned U.S. patent application Ser. No. 09/473,424, filed concurrently herewith and entitled "CLEANING WEB DETECTOR GAUGE".

FIELD OF THE INVENTION

This invention relates in general to a device for cleaning fusers for electrographic reproduction apparatus, and more particularly to a reproduction apparatus fuser cleaning web and a cleaning web advancement and control mechanism.

BACKGROUND OF THE INVENTION

In typical commercial electrographic reproduction apparatus (copier/duplicators, printers, or the like), a latent image charge pattern is formed on a uniformly charged charge-retentive or photoconductive member having dielectric characteristics (hereinafter referred to as the dielectric support member). Pigmented marking particles are attracted to the latent image charge pattern to develop such image on the dielectric support member. A receiver member, such as a sheet of paper, transparency or other medium, is then brought into contact with the dielectric support member, and an electric field applied to transfer the marking particle developed image to the receiver member from the dielectric support member. After transfer, the receiver member bearing the transferred image is transported away from the dielectric support member, and the image is fixed (fused) to the receiver member by heat and pressure to form a permanent reproduction thereon.

One type of fuser assembly, utilized in typical reproduction apparatus, includes at least one heated roller and at least one pressure roller in nip relation with the heated roller. The fuser assembly rollers are rotated to transport a receiver member, bearing a marking particle image, through the nip between the rollers. The pigmented marking particles of the transferred image on the surface of the receiver member soften and become tacky in the heat. Under the pressure, the softened tacky marking particles attach to each other and are partially imbibed into the interstices of the fibers at the surface of the receiver member. Accordingly, upon cooling, the marking particle image is permanently fixed to the receiver member.

With fuser assemblies of the above described type, it has been found that there is a tendency of a portion of the marking particles in an image to adhere to the pressure roller rather than remaining with the receiver member during the fusing operation. This is referred to as image offset. Thereafter the offset marking particles can transfer back to subsequent receiver members being fused to form undesirable image artifacts such as ghost images for example. Also, the offset marking particles may transfer to the fuser roller when no receiver member is present therebetween and then to the back-side of subsequent receiver members to form undesirable marks thereon. In order to minimize this image offset effect, an offset preventing oil is applied to the rollers of the fuser assembly. The offset preventing oil has a viscosity which, lowers the surface energy of the rollers and makes it less likely that marking particles will adhere thereto.

Since the offset preventing oil is not one hundred percent efficient in preventing image offset, and because the offset preventing oil itself can cause some image artifact problems during fusing, it has been found desirable to provide a mechanism for cleaning the fuser rollers of residual marking particles and excess offset preventing oil. One general type of cleaning mechanism used in reproduction apparatus includes a web cleaner. For example a typical web cleaner is shown in U.S. Pat. No. 4,853,741, issued Aug. 1, 1989, in the name of Ku, for cleaning photoconductive webs. The web cleaner has a roll of cloth material that runs from a supply roll to a take-up roll and is in contact with the surface to be cleaned (e.g., photoconductive web, fuser roller or pressure roller of a fuser assembly, or a transfer roller). After a predetermined number of reproductions have been made, the cloth material web is advanced a few degrees to the take-up roll to provide a clean web surface in contact with the surface to be cleaned. It has, however, been found that there is difficulty in precisely controlling the amount of web material that is periodically advanced so that the web roll may be most efficiently used and the need for replacement of the web roll is minimized.

SUMMARY OF THE INVENTION

In view of the above, this invention is directed to a mechanism for cleaning the surface of an operative element of a reproduction apparatus. The cleaning mechanism includes an elongated web of cleaning cloth material. A first support provides a supply of the elongated web of cleaning cloth material, and a second support provides a take-up for the elongated web of cleaning cloth material. A motor is operatively coupled to the second support to drive the second support for selectively advancing of the elongated web of cleaning cloth material from the first support to the second support to provide a clean portion of the elongated web of cleaning cloth material to clean the operative element. An encoder, associated with the motor, produces a string of pulses while the motor is operative to drive the second support. A logic and control unit produces a signal for turning the motor on for a period of time establishing a web advancement cycle where a given predetermined number of pulses in a pulse string are produced by the encoder. Responsive to the actual number of pulses in the pulse string of an advancement cycle, the period of time that the motor is turned on in a subsequent advancement cycle is adjusted based on the actual number of pulses in a previous string of pulses in order to adjust advancement of the web to provide for the most efficient use of the web of cleaning cloth material.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
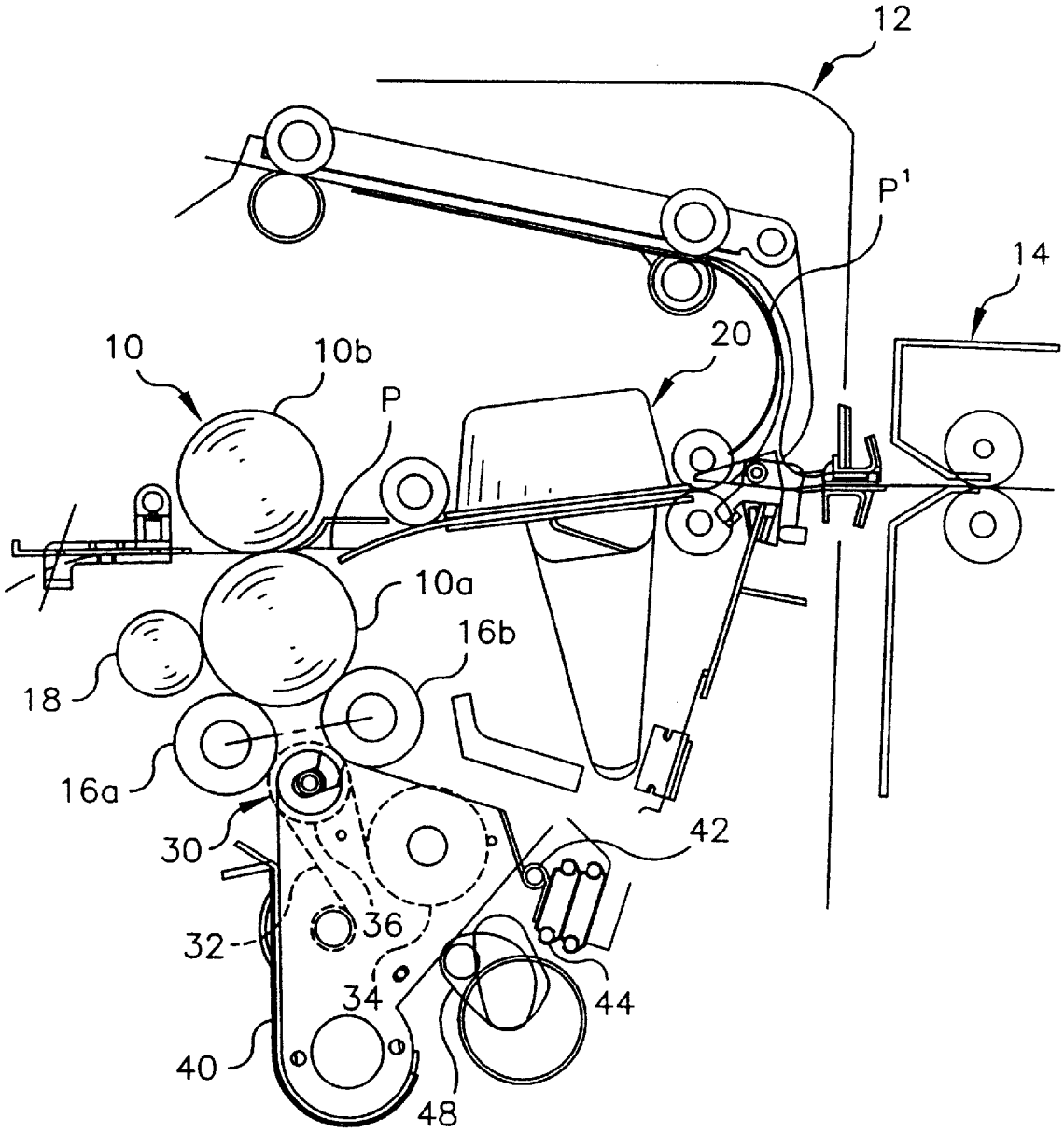
FIG. 1 is a side elevational view of a cleaning mechanism, shown in association with an electrographic reproduction apparatus fuser assembly and post fuser assembly transport path, with portions broken away or removed to facilitate viewing.

Referring now to the accompanying drawings, FIG. 1 shows an exemplary fuser assembly 10 for an electrographic reproduction apparatus 12. The fuser assembly 10 includes a heated fusing roller 10*a* in nip relation with a pressure roller 10*b*. The fusing nip between the rollers 10*a*, 10*b* is associated with the transport path P of the reproduction apparatus 12. That is, as a receiver sheet bearing a marking particle image is transported along the path P, the marking particle image is fixed to a receiver sheet by application of heat and pressure in the fusing nip before the receiver sheet is delivered from the transport path P to an output device 14 or a duplex reproduction recirculation path P40. Substantially immediately downstream of the fuser assembly 10, in the direction of receiver sheet travel, is an air impingement cooler device, designated generally by the numeral 20, more fully described in copending U.S. patent application Ser. No. 09/464,423, filed Dec. 16, 1999, in the names of Kowalski et al.

Heat to the fusing roller 10*a* is supplied by a pair of external heater rollers 16*a* and 16*b* in contact with the peripheral surface of the fusing roller. Additionally, an oiler device 18, of any suitable construction well known in the prior art, contacts the fusing roller 10*a* to apply offset preventing oil to the fusing roller. The web cleaner mechanism 30 for removing residual marking particles and excess offset preventing oil is shown in a preferred embodiment as having an elongated cleaning material cloth web 32 located in an operative position to contact the heater rollers 16*a*, 16*b*. Of course, the mechanism 30 could also be arranged, without departing from this invention, such that the cloth web directly contacts the fusing roller 10*a*, the pressure roller 10*b*, or for example any other assembly within the reproduction apparatus 12 to be cleaned (e.g., transfer roller, photoconductor, etc.).

Figure 2:
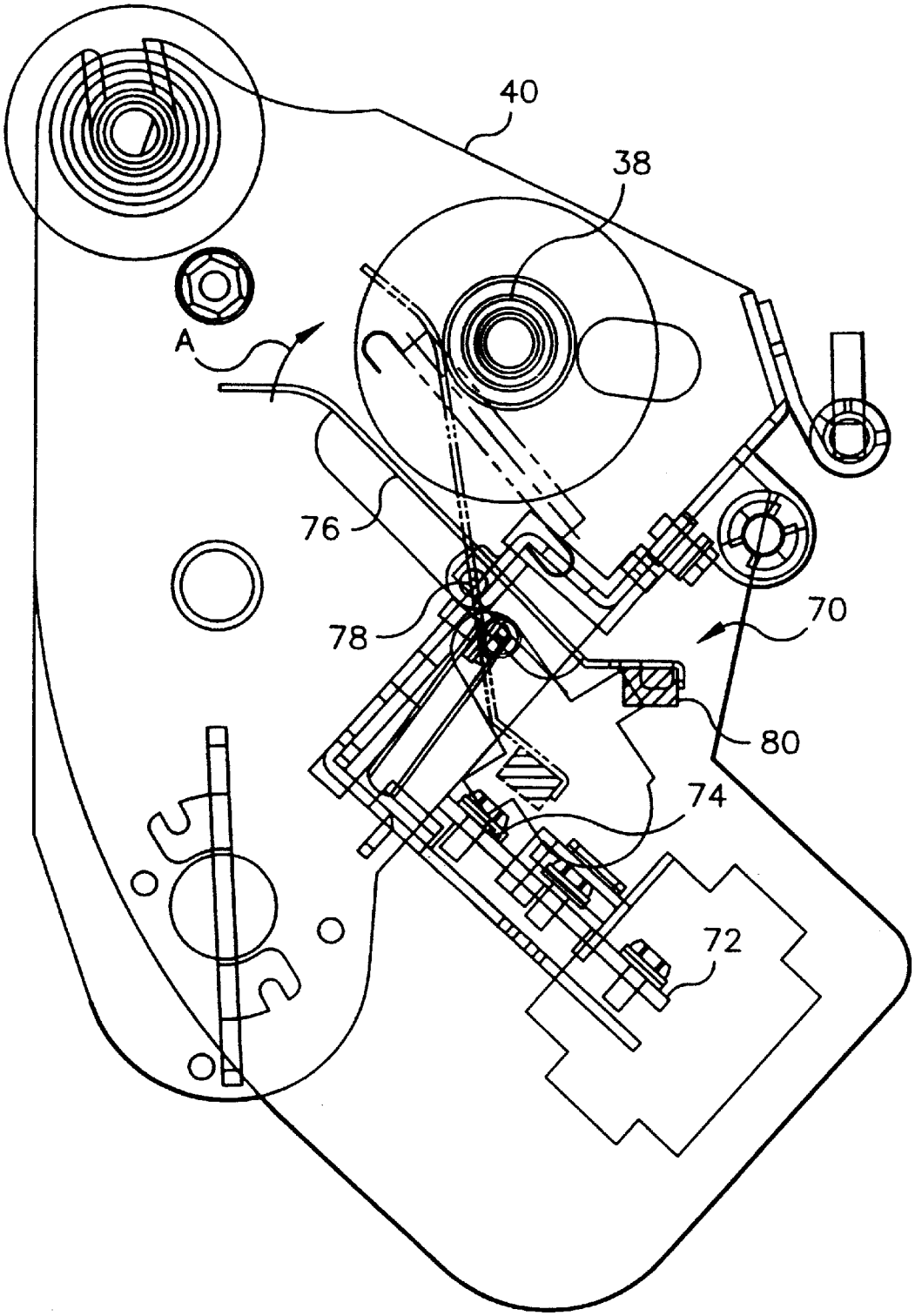
FIG. 2 is a side elevational view, on an enlarged scale of the web cleaning device including the web sensor gauge.

The cleaning web material cloth web 32 of the cleaning mechanism 30 is supported on a supply reel 34, rides over a foam roller 36, and is connected to a take-up reel 38 (see FIG. 2). The supply reel 34, the foam roller 36, and the take-up reel 38 are mounted in operative relation on a frame 40. The frame 40 is, in turn, supported on a pivot rod 42 connected to a guide rail 44. The support of the frame 40 on the pivot rod 42 enables the frame to move about the longitudinal axis of the pivot rod and along the longitudinal axis of the pivot rod. That is, the frame 40 can move with the guide rail 44 in a direction along the longitudinal axis of the pivot rod 42 to locate the frame (and thus the cleaning mechanism 30) in operative association with the fuser assembly 10, or at a location external to the reproduction apparatus 12 so that the cleaning mechanism can be easily serviced or the cloth web 32 readily replaced. Further, when the frame 40 is located in the interior of the reproduction apparatus, the frame can be moved about the longitudinal axis of the pivot rod 42 by, for example, the cam mechanism 48. As such, the cloth web can be located in operative cleaning engagement with the heater rollers 16*a*, 16*b* of the fuser assembly 10, or remote from engagement with the heater rollers.

The material cloth web 32 of the cleaning mechanism 30 must be periodically advanced so to have clean material present at the heater rollers 16*a*, 16*b* to efficiently clean such rollers (or any other assembly with which the cleaning mechanism according to this invention is suitably associated). The material cloth web 32 is advanced in a manner which will enable accurate usage of the material, detect a failure of the material, and permit the amount of incremental advancement of the web to be easily changed.

Figure 3:
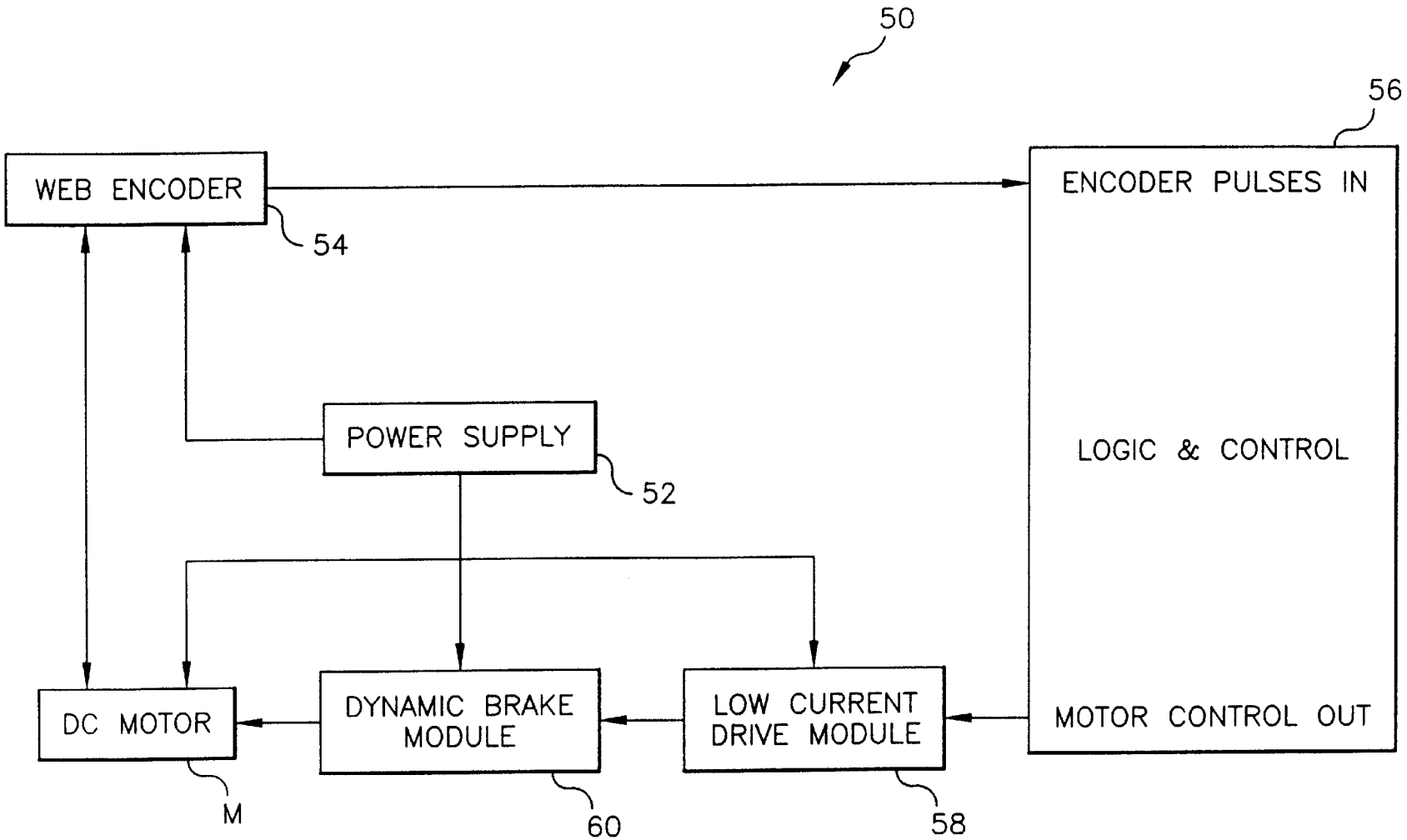
FIG. 3 is a schematic block diagram of the operating mechanism for the cleaning device, shown in FIG. 2, according to this invention.

A cleaning web advancement and motor control system 50, as shown in FIG. 3, includes a power supply 52 for activating a motor M (for example, a DC motor) for driving the take-up reel 38, and a web encoder 54 associated with the motor for determining the amount of rotation of the take-up reel by the motor. The web encoder 54 enables accurate, automatically adjustable, incremental advancement of the material cloth web to be established so as not to waste web material and allow the material to last for a significant number of reproductions. The encoder 54 produces a pulse stream that is sent to a logic and control unit 56.

The logic and control unit 56 uses the pulse train information to control the length of time the power supply 52 is activated to power the motor M to rotate the take-up reel 38. As such, the material cloth web 32 will be incrementally advanced a desired precise amount by activating the motor M for a period of time which produces a predetermined number of encoder pulses. It has been found that, in the preferred embodiment for cleaning the fuser assembly heater rollers 16*a*, 16*b* that the material cloth web must be advanced at an increment of approximately 0.100 inch every 250 reproductions by the reproduction apparatus to properly clean the heater rollers and provide sufficient life of the web so that the web material will function at optimum cleaning efficiency, and will not have to be replaced too frequently.

The logic and control unit 56 activates the DC motor M to drive the take-up reel 38 and move the material cloth web 32 across the foam roller 36. The take-up reel 38 is driven by a motor control output signal sent to the motor M by the logic and control unit 56 through, for example a low current drive module 58. The low current drive module 58 allows the logic and control unit 56 to drive the high current DC motor M with a low current signal that protects the logic circuits. The drive motor M rotates the take-up reel 38 and the encoder 36 through a belt drive coupler (not shown) for example. The desired incremental advancement of the material cloth web 32 of 0.100 inch is equal to the reading of three encoder pulses by the logic and control unit 56. After the reading of the predetermined number of encoder pulses corresponding to the desired incremental advancement of the web (in the preferred embodiment, three encoder pulses), the enable signal to the motor M by the logic and control unit is removed.

Since the drive motor M has the tendency to coast after power is removed, a dynamic brake module 60 is incorporated to reduce the amount of motor coast. This will substantially prevent over drive of the take-up reel 38 and unnecessary usage of the web material. To further ensure that the average incremental advancement of the material cloth web (e.g., 0.100 inch) is maintained, the logic and control unit 56 acts to compensate in a subsequent incremental advancement cycle if the immediately previous incremental advancement cycle has recorded more than the predetermined number of encoder pulses. This is accomplished by subtracting the same number of pulses greater than the number of encoder pulses actually counted in the previous incremental advancement cycle from the predetermined number of pulses, and using such result as the predetermined number of pulses for the next subsequent incremental advancement cycle.

By this arrangement, it also possible to readily detect a broken material cloth web for the cleaning mechanism 30. That is, should the web material break, there would be a break in the rotation of the encoder and thus a loss of encoder pulses to the logic and control unit 56. Accordingly, in response to the loss of encoder pulses, the logic and control unit could provide a visual/audible warning signal, and the cleaning mechanism 30 could be disengaged from the heater rollers 16*a*, 16*b* by the cam mechanism 48 so as to substantially prevent physical damage to the heater rollers.

It is also desired, according to this invention, to provide for detection of the amount of material cloth web remaining so as to know the number of reproductions left which may be cleaned by the existing web roll, detection of the amount of material cloth web left until a low condition is reached, and detection when the material cloth web supply reel is empty. Of course, the supply reel empty signal would then tell logic and control unit 56 to activate the cam mechanism 48 to disengage the cleaning mechanism 30 from the heater rollers 16*a,* 16*b* so as to substantially prevent physical damage to the heater rollers.

FIG. 2 shows the detail construction for a cleaning web detector gauge, designated generally by the numeral 70, which enables an accurate output reading of material cloth web on the supply reel 38 of the cleaning mechanism 30. The cleaning web detector gauge 70 includes a printed electronic circuit board 72, mounted on the frame 40, utilizing a miniature ratiometric linear solid state sensor 74 mounted thereto. A detector arm 76 is pivotally supported on a pivot pin 78 mounted on the frame 40. The pivot pin 78 is located such that one end of the detector arm is associated with the peripheral surface of the outer diameter of the material cloth web 32 on the supply reel 38, and the other end of the arm supports a magnet 80, such as of the rare earth type.

The detector arm 76 of the detector gauge 70 is urged, by any well known urging mechanism, in a direction, of arrow A, about the longitudinal axis of the pivot pin 78 (clockwise in FIG. 2) such that the end of the arm contacting the outer diameter of the peripheral surface of the material cloth web 32 follows such peripheral surface as the web is depleted and the diameter decreases (from the solid line position shown in FIG. 2 to the broken line position). Further, the end of the arm carrying the magnet 80, and thus the magnet, approaches the sensor 74. The output voltage of the sensor 74 varies in proportion to the strength of the magnetic field created by magnet 80. As a result, as the magnet 80 comes closer to the sensor 74, the magnetic field strength will increase and the output voltage from the sensor will change proportionally to provide a signal to a logic system (for example the logic and control unit 56, or an independent logic and control unit) at a level corresponding to the remaining number of reproductions left before the web roll had to be replaced.

The cleaning web gauge detector circuit on the circuit board 72 eliminates the subjectiveness from determining how much web remains on the supply reel 38, and therefore how many more copies can be produced before the web material runs out and causes a failure. The failure would result in contamination of the fuser roller and/or heater rollers that would reduce output image quality and cause the customer to call for service. As the web roll is depleted and the surface diameter becomes smaller, the sensor circuit output voltage will change. In the program for the logic and control unit, the voltage signal is converted to the number of copies left so the service person can decide if the roll will last until a subsequent service call or if it should be replaced during the present service call. In developing the program, an empty web supply reel is installed and an OUT voltage is measured and stored. This stored value and a predetermined delta voltage is formulated to set the limits for the LOW and OUT condition of the material cloth web on the supply reel. In this manner, the accommodation of these parameters take into account for part tolerances and position of the solid state sensor on the printed circuit board and in its relation to the magnet for cleaning mechanisms of specific reproduction apparatus.

The invention has been described in detail with particular reference to certain preferred embodiments thereof, but it will be understood that variations and modifications can be effected within the spirit and scope of the invention.

What is claimed is:

1. A mechanism for cleaning the surface of an operative element of a reproduction apparatus, said cleaning mechanism comprising:

an elongated web of cleaning cloth material;

a first support which provides a supply of said elongated web of cleaning cloth material, and a second support which provides a take-up for said elongated web of cleaning cloth material;

a motor operatively coupled to said second support to drive said second support for selectively advancing of said elongated web of cleaning cloth material from said first support to said second support to provide a clean portion of said elongated web of cleaning cloth material to clean said operative element;

an encoder, associated with said motor, for producing a string of pulses while said motor is operative to drive said second support; and a logic and control unit producing a signal for turning said motor on for a period of time establishing a web advancement cycle where a given predetermined number of pulses in a pulse string are produced by said encoder, and responsive to the actual number of pulses in said pulse string of an advancement cycle, adjusting said period of time that said motor is turned on in a subsequent advancement cycle based on said actual number of pulses in a previous string of pulses in order to adjust advancement of said web to provide for the most efficient use of said web of cleaning cloth material.

2. The cleaning mechanism according to claim 1 wherein said first support is a first reel, and said second support is a second reel spaced from said first reel.

3. The cleaning mechanism according to claim 2 further including a third support, between said first support and said second support, and over which said elongated web is entrained in operative association with the surface of the operative element to be cleaned.

4. The cleaning mechanism according to claim 3 wherein said third support is a roller.

5. The cleaning mechanism according to claim 1 wherein said logic and control unit further senses when there is an absence of a string of pulses during a time when said motor is turned on thus indicating a break in said web of cleaning cloth material, and produces a warning signal indicative of such break in said web of cleaning cloth material.

6. The cleaning mechanism according to claim 1 wherein a dynamic brake is associated with said motor so as to inhibit over drive of said motor and reduce the amount of motor coast.

7. The cleaning mechanism according to claim 6 wherein said motor is a DC motor.

8. The cleaning mechanism according to claim 7 wherein a low current drive module is associated with said dynamic brake and said DC motor to drive said motor with a low current signal that protects the logic circuits of said logic and control unit.

9. In a reproduction apparatus having a operative element roller device required to be periodically cleaned so that said reproduction apparatus operates at peak efficiency, a mechanism for cleaning the surface of said operative element roller device, said cleaning mechanism comprising:

an elongated web of cleaning cloth material;

a first support reel for providing a supply of said elongated web of cleaning cloth material, and a second support reel for providing a take-up for said elongated web of cleaning cloth material;

a roller located between said first support reel and said second support reel, and over which said elongated web of cloth material is entrained in operative association with the surface of said operative element roller device to be cleaned;

a motor operatively coupled to said second support reel to drive said second support reel to take up said elongated web of cloth material for selective moving of said elongated web of cleaning cloth material from said first support reel over said roller support to said second support reel to provide a clean portion of said elongated web of cleaning cloth material to clean the surface of said roller device;

an encoder, associated with said motor, for producing a string of pulses while said motor is operative to drive said second support reel; and a logic and control unit producing a signal for turning said motor on for a period of time where a given predetermined number of pulses in a pulse string are produced by said encoder, and responsive to the actual number of pulses in said pulse string, adjusting said period of time that said motor is turned on in a subsequent advancement cycle based on said actual number of pulses in a previous string of pulses in order advance said web to provide for the most efficient use of said web of cleaning cloth material.

10. The cleaning mechanism according to claim 9 wherein said logic and control unit includes a device for sensing when there is an absence of a string of pulses during a time when said motor is turned on thus indicating a break in said web of cleaning cloth material, and producing a warning signal indicative of such break in said web of cleaning cloth material.

11. The cleaning mechanism according to claim 9 wherein a dynamic brake is associated with said motor so as to inhibit over drive of said motor and reduce the amount of motor coast.

12. The cleaning mechanism according to claim 11 wherein said motor is a DC motor, and a low current drive module is associated with said dynamic brake and said DC motor to drive said motor with a low current signal that protects the logic circuits of said logic and control unit.

* * * * *